US006340522B1

(12) United States Patent
Burke et al.

(10) Patent No.: US 6,340,522 B1
(45) Date of Patent: Jan. 22, 2002

(54) THREE-DIMENSIONAL TWISTED FIBERS AND PROCESSES FOR MAKING SAME

(75) Inventors: Sean Burke, Leitches Creek (CA); Michael B. Macklin, Westford; Klaus-Alexander Rieder, Salem, both of MA (US); Jean-François Trottier, Bedford (CA)

(73) Assignees: WR Grace & Co.-Conn., New York, NY (US); Atlantic Fiber Technologies Limited, Nova Scotia (CA)

( * ) Notice: Subject to any disclaimer, the term of this patent is extended or adjusted under 35 U.S.C. 154(b) by 0 days.

(21) Appl. No.: 09/615,595

(22) Filed: Jul. 13, 2000

(51) Int. Cl.[7] ..... D01F 6/00
(52) U.S. Cl. ..... 428/359; 428/369; 428/399
(58) Field of Search ..... 428/399, 369, 428/359

(56) References Cited

U.S. PATENT DOCUMENTS

| | | | | | |
|---|---|---|---|---|---|
| 2,812,782 | A | * | 11/1957 | Stevens et al. | 428/369 |
| 3,716,386 | A | | 2/1973 | Kempster et al. | |
| 3,903,879 | A | * | 9/1975 | Riley | 128/91 R |
| 4,121,943 | A | | 10/1978 | Akazawa et al. | |
| 4,171,401 | A | * | 10/1979 | Legrix et al. | 428/369 |
| 4,224,377 | A | | 9/1980 | Moens | |
| 4,278,726 | A | * | 7/1981 | Wieme | 428/229 |
| 4,314,853 | A | | 2/1982 | Moens | |
| 4,910,076 | A | * | 3/1990 | Ando et al. | 428/245 |
| 5,399,195 | A | | 3/1995 | Hansen et al. | |
| 5,561,173 | A | * | 10/1996 | Dry | 523/218 |
| 5,725,954 | A | * | 3/1998 | Muntsinger | 428/400 |
| 5,753,368 | A | | 5/1998 | Berke et al. | |
| 5,807,458 | A | | 9/1998 | Sanders et al. | |
| 5,981,630 | A | * | 11/1999 | Bunthiq et al. | 428/369 |
| 5,985,449 | A | * | 11/1999 | Dill | 428/369 |
| 5,989,334 | A | * | 11/1999 | Dry | 428/364 |
| 6,177,195 | B1 | * | 1/2001 | Yabuki et al. | 428/399 |

FOREIGN PATENT DOCUMENTS

| | | |
|---|---|---|
| WO | WO 99/36640 | 7/1999 |
| WO | WO 99/46214 | 9/1999 |

* cited by examiner

*Primary Examiner*—N. Edwards
(74) *Attorney, Agent, or Firm*—Oliff & Berridge, PLC

(57) ABSTRACT

Exemplary fibers of the invention, useful for reinforcing hydratable cementitious materials such as concrete and mortar, have three-dimensional twist curvatures. Preferably, the fibers are flat or flattened and have first and second opposed flat or flattened ends that are twisted out of phase, and which preferably define therebetween an intermediate elongate fiber body having a curvature in more than one direction. Processes of the invention comprise forming a fiber with a three-dimensional twisted shape by twisting at least two fibers together to form a twisted fiber bundle to impart a twist curvature into the fiber material. The twisted fiber bundle can then be cut into separate fibers or stored on bobbins for shipment to another location for cutting. Advantages of the invention include enhanced dispersibility of the fibers in hydratable cementitious compositions.

18 Claims, 4 Drawing Sheets

THREE-DIMENSIONAL TWISTED FIBERS AND PROCESSES FOR MAKING SAME

FIELD OF THE INVENTION

The present invention relates to fibers for reinforcing matrix materials such as mortar, concrete, shotcrete, rubber, plastic, bituminous concrete, gypsum compositions, or asphalt and more particularly to fibers having a three-dimensional twist for enhancing dispersibility of fibers within mortar and concrete.

BACKGROUND OF THE INVENTION

The present invention particularly focuses on the problem of dispersing fibers within castable compositions such as fresh cementitious mixes. The problems associated with adding fibers to concrete and avoiding fiber clumping or balling is well documented in "Guide for Specifying, Proportioning, Mixing, Placing, and Finishing Steel Fiber Reinforced Concrete" (Document number ACI 544.3R-93) as reported by American Concrete Institute Committee 544.

Over the years numerous innovative methods of packaging and bundling fibers, surface treatments and mechanical means of adding fibers to a concrete mixture have been devised in order to try and overcome the problem of fiber balling or clumping. U.S. Pat. No. 4,121,943 (Akazawa et al.) describes a machine designed to separate fibers into separate units prior to adding them to a concrete mixture. U.S. Pat. No. 3,716,386 (Kempster) describes a process whereby the fibers are coated with a friction reducing substance prior to their introduction to a concrete mixture. U.S. Pat. Nos. 4,224,377 and 4,314,853 (Moens) describe a method whereby a plurality of wire elements are united by a binder which loses its binding ability during the mixing process. U.S. Pat. No. 5,807,458 (Sanders et. al.) describes a method for reinforcing castable compositions through the use of reinforcing elements maintained in a close-packed alignment in a dispersible containment means.

A factor common to the last two described methods for achieving high addition rates of high aspect ratio fibers into concrete is to introduce the fibers in a organized array that on mixing slowly release the fibers in an aligned array. Fibers released into cementitious compositions in this manner experience fewer fiber-fiber interactions and subsequently show less tendency to clumping or balling as compared to the same fibers that are added to cementitious compositions in a totally random orientation. This fiber clumping or balling means that the individual fiber strands do not disperse uniformly throughout the concrete mix, and therefore they may fall short of imparting the desired structural reinforcement to the resultant hardened concrete matrix or unit as a whole. One significant drawback of the last two described methods is that the release of the fibers in the mixing unit is dependent on the rate at which the dispersible containment or the binder will dissolve. Therefore, mixing operations involving short mixing cycles may not allow enough time for the entire release of the fibers from the dispersible containment or the total dissolution of the binder uniting the fibers. The fibers in the present invention do not rely on any binding agent or dispersible containment for proper release and dispersion and can therefore be used in operations where short mixing cycles are involved.

The present invention covers fibers that can be rapidly added to a cementitious composition in a completely random orientation with no fiber clumping or balling occurring.

SUMMARY OF THE INVENTION

The present invention provides fibers for reinforcing matrix materials such as hydraulic cementitious materials (e.g., mortar, concrete). Exemplary fibers of the invention have an average length of 5–100 mm, an average width of 0.25–8.0 mm, and first and second opposed ends each having width and thickness dimensions with width dimensions exceeding thickness dimensions, said widths of said first and said second opposed ends being twisted and thereby having different orientations. Preferably, the widths are oriented in directions that are non-coplanar with each other, and more preferably between 15°–720° out of phase with each other (the upper number representing two complete twists) and more preferably between 15°–360° out of phase with each other. The fibers can be made of one or more synthetic polymers (e.g., polypropylene, polyethylene, etc.), steel, or other materials.

In other exemplary embodiments, the fibers have intermediate body portions defined between the first and second opposed fiber ends which have a three-dimensional curve or twist. For example, if the fiber body when stretched into a straight line is deemed to occupy the "z" axis, then the fibers can be deemed to have a curve in the "x" direction (defined along the width dimension of the fibers), as well as a curve in the "y" direction (defined along the thickness dimension of the fibers).

The curvature of the fibers can be mathematically described using the following equation:

$$\begin{pmatrix} x \\ y \\ z \end{pmatrix} = \begin{pmatrix} a \cdot \cos(\omega_1 \cdot \tau) \\ b \cdot \sin(\omega_2 \cdot \tau) \\ v \cdot \tau \end{pmatrix} \quad \begin{matrix} \omega_1, \omega_2, v, \tau \in \mathcal{R} \\ 0.25\text{mm} \le a, b \le 25\text{mm} \end{matrix}$$

To obtain a full twist for a given length l in z direction the following equation has to be fulfilled:

$$v = \frac{l \cdot (\omega_1 + \omega_2)}{4 \cdot Pi}$$

A preferred process for making the aforementioned exemplary fibers of the invention comprises twisting together 2–5000 and more preferably 6–24 fiber strands (each strand of which can be a monofilament, multifilament, or which in turn can comprise further strands), and then cutting the twisted fiber bundle into separate fiber pieces which will have the twisted structure, as described above. The memory of the twist shape is generally maintained in the fiber material after cutting into separate fiber pieces. The memory of the twist shape in the fiber material can be enhanced by introducing the twisted fiber bundle (before cutting) against and around one or more pulleys to impart tension on the twisted fiber bundle material, or such as by introducing the twisted fiber bundle between rollers to flatten or crush them or otherwise to impart the twisted shape into the memory of the fibers. Heating of the twisted fiber bundle before cutting can also impart the twisted shape into the memory of the fibers.

Preferably, the plurality of fibers made in accordance with the invention will have curvatures or arches retained in the material memory (slightly bent portions between opposing ends of the fiber) that vary from fiber to fiber, and this can be achieved depending upon the nature of the material (polymer, steel, other) and number of twists per fiber length, such as 1–96 twists and more preferably about 6–8 twists per linear foot of fiber. The cutting of fibers when in a twisted-together state surprisingly provides a plurality of fibers that have different curvatures as well as opposing cut ends that can veer off in different directions.

The unique twisted structure of the resultant fibers enhances the dispersibility of the fibers in a matrix composition such as concrete. In the present invention, the ability to impart a curvature as a result of the twisting will generate a plurality of individual fibers having different curvatures (because at any given point on the twisted fiber bundle the individual fibers will have different curvatures) as well as different bias properties. The different bias properties arise because the curves or bends arise at different portions of the fiber length, and the bias properties are such that the fibers are naturally biased away from each other after the cutting process. The inventors believe that the variable bias created by the varying curvatures in the twisted fibers helps to separate the individual fibers after they are introduced into the matrix composition.

Twisting-fibers together provides numerous other advantages and benefits. One such advantage is the convenience of processing a high number of fiber strands at once through a cutter at a high rate of speed. The twisting of the strands also provides convenience in handling.

In addition to fibers and processes for making them, the invention also provides methods for modifying cementitious compositions, such as by introducing the above-described fibers into wet concrete or mortar. The invention is also directed to hydratable cementitious compositions having the above-described fibers.

Further advantages and features of the exemplary fibers, methods, and compositions of the invention may become more apparent in discussion hereinafter.

DETAILED DESCRIPTION OF EXEMPLARY EMBODIMENTS

Figure 1:
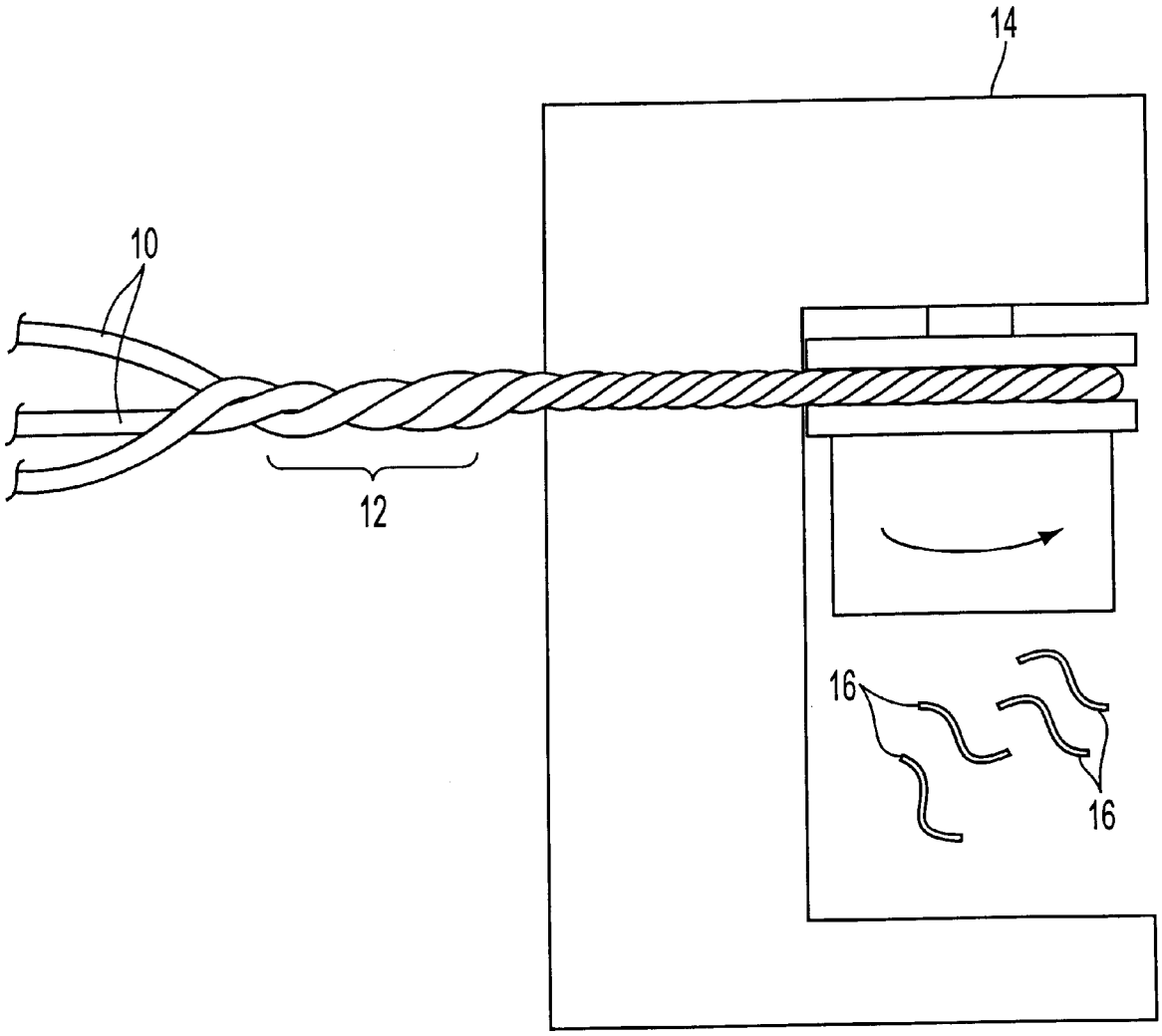
FIG. 1 is a diagramatic illustration of an exemplary process of the invention.

As previously mentioned, the term "concrete" refers to a composition containing a cement binder, usually with fine and coarse aggregates. As used hereinafter, however, the term is used analogously to refer to any cementitious material, such as cement (Portland cement), mortar cement, and masonry, into which fibers may be incorporated for purposes of reinforcing the material when hardened. In addition to concrete, the invention is believed applicable to other building product formulations, including concrete, shotcrete, bricks, plaster, white-top, synthetic composites, carbon-based composites, asphalt and the like. In a preferred embodiment of the invention, the Portland cement-based formulation is concrete comprised of Portland cement, sand, and stone (such as gravel or crushed rock).

Exemplary fiber materials suitable for use in the invention having desirable performance properties in concrete, such as resilience, tensile strength, toughness, resistance to changes in pH, and resistance to moisture, sufficient to render such materials useful for reinforcing building product formulations under standard loads and conditions. Conventional materials used for making reinforcing fibers are therefore believed suitable for use in the present invention.

Examples of suitable fiber materials may include mixtures of two or more polymers, such as polypropylene and polyethylene. Preferably, the polyethylene/polypropylene polymer combinations will have a tenacity of about 6.0 to 15 grams per denier, a specific gravity of about 0.89 to 0.95 and a stretch elongation in the range of about 15% up to about 20%. In a preferred aspect of the invention, the fiber comprise a polyethylene/polypropylene polymer blend exclusively, and are not held together by any type of adhesive agent.

The fibers of the present invention are preferably comprised of at least one synthetic polymer (e.g., a polyolefin) and more preferably a "multipolymer" blend that comprises two or more polymers (e.g., polypropylene and polyethylene, polypropylene and polystyrene). While exemplary fibers of the invention may comprise a single polymer such as polypropylene, the more preferred embodiments comprise monofilaments having two or more polymers, such as polypropylene and polyethylene, or other polymers having different moduli of elasticity. A suitable multipolymer blend fiber is disclosed, for example, in World Patent Appln. No. WO 99/46214 of J. F. Trottier et al., which is incorporated herein by reference. Exemplary fiber material is also commercially available from East Coast Rope Ltd., of North Sydney, Nova Scotia, Canada, under the tradename "POLYSTEEL". Fibers which can be used in concrete, for example, can include any inorganic or organic polymer fiber which has the requisite alkaline resistance, strength, and stability for use in reinforcing hydratable cementitious structures. Exemplary fibers of the invention are synthetic materials such as polyolefins, nylon, polyester, cellulose, rayons, acrylics, polyvinyl alcohol, or mixture thereof. However, polyolefins such as polypropylene and polyethylene are preferred. Polyolefins may be used in monofilament, multifilament, collated fibrillated, ribbon form, or have shapes or various sizes, dimensions, and arrays. Fibers may be coated, using the materials taught in U.S. Pat. No. 5,399,195 of Hansen (known wetting agents) or in U.S. Pat. No. 5,753,368 of Berke et al. (concrete bonding strength enhancement coatings).

Further exemplary embodiments of the invention may comprise twisting together different fiber materials to form a twisted fiber bundle, running the twisted fiber bundle through one or more pulleys or between rollers to impart the twisting shape to the twisted fiber bundle, and then cutting the resultant twisted fiber bundle to provide separate fibers having a three-dimensional twist shape.

Preferred fibers are provided in "monofilament" form. The term "monofilament" refers to the shape of the treated fiber which is provided (literally) as "one filament" (i.e. a unified filament). The term "monofilament" as used herein does not preclude the possibility that the singular filament may, when subjected to agitating forces within a concrete mix (e.g., one having fine and/or coarse aggregates), break down further into smaller filaments or strands when subjected to the agitation, for example, in a concrete mix due to the comminuting action of aggregates (e.g., sand, stones, or gravel). The term "monofilament" is used in contradistinction from the term "multifilament" which refers to a bunch of fibers that are intertwined together or otherwise bundled together such that they have a plurality of separate strands. (To large extent, a fiber can be defined as either monofilament or multifilament depending upon whether one is able to visually discern the separate fibrils at a certain point in time). In any event, the fibers and methods of the present invention are contemplated to include, and to be applicable to, both monofilament and multifilament fibers.

A preferred embodiment of the invention pertains to "multipolymer" fibers. It is believed by the present inventors that such fibers (having two or more different polymers, such as a mixture of polypropylene and polyethylene or a mixture of polypropylene and polystyrene, for example) provide better pull-out resistance from hydratable cementitious matrix materials (e.g., ready mix concrete).

The inventors have realized that the twist-imparting process greatly enhances fibrillation and/or dispersibility properties of fibers, and particularly multipolymer fibers such as taught in World Patent Appln. No. WO 99/46214 of J. F. Trottier et al., which is incorporated herein by reference.

FIG. 1 illustrates an exemplary process of the invention for making three-dimensional twisted fibers in accordance with the invention. Two or more fibers 10 are twisted together 12 and introduced in a cutter 14 and cut into separate fibers 16. In alternative embodiments, the twisted fiber bundle may be stored on a bobbin (not shown) before cutting 14. This would permit a bobbin or reel of twisted fiber bundle to be shipped, for example, to another location at which the fiber could be cut to the desired length. Alternatively, the bundle of twisted fiber strands can be flattened by temporarily subjecting the cable to a force (such as between opposed rollers) so as to compress the twisted fiber bundle (for a moment) to further impart the twisted shape into the memory of the fibers. Alternatively, a twisted fiber bundle can be made by twisting strands under tension together. For example, the fibers can be twisted into a fiber bundle and subjected to tension by running the twisted fiber bundle around one or more pulleys. Preferably, the pulleys are arranged in a series whereby the twisted fiber bundle is forced into different directions of travel while under tension, prior to cutting. Thus, by these means can a series of pulleys be used to to impart tension to the twisted fiber bundle and thereby maintain the memory of the twisted shape in the fiber material. Alternatively, the twisted fiber bundle can be subjected to heat just prior to cutting to further impart the twisted shape into the memory of the fibers. The twist-shaped fiber bundle can then be stored onto bobbins for shipment, or may be directly cut into separate twisted fiber pieces.

Figure 2:
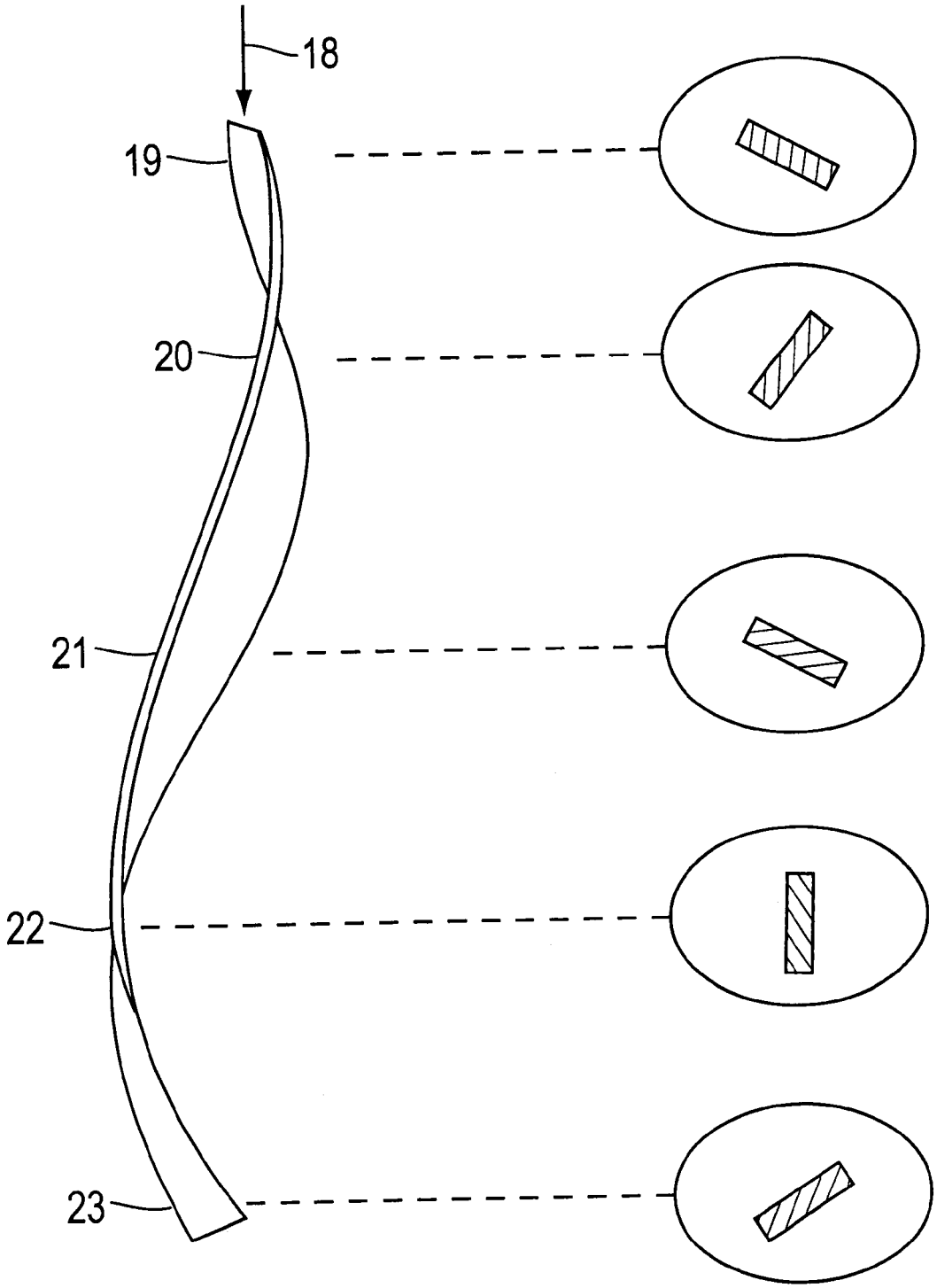
FIG. 2 is a perspective illustration of an exemplary twisted fiber of the present invention made by the process shown in FIG. 1.
Figure 3:
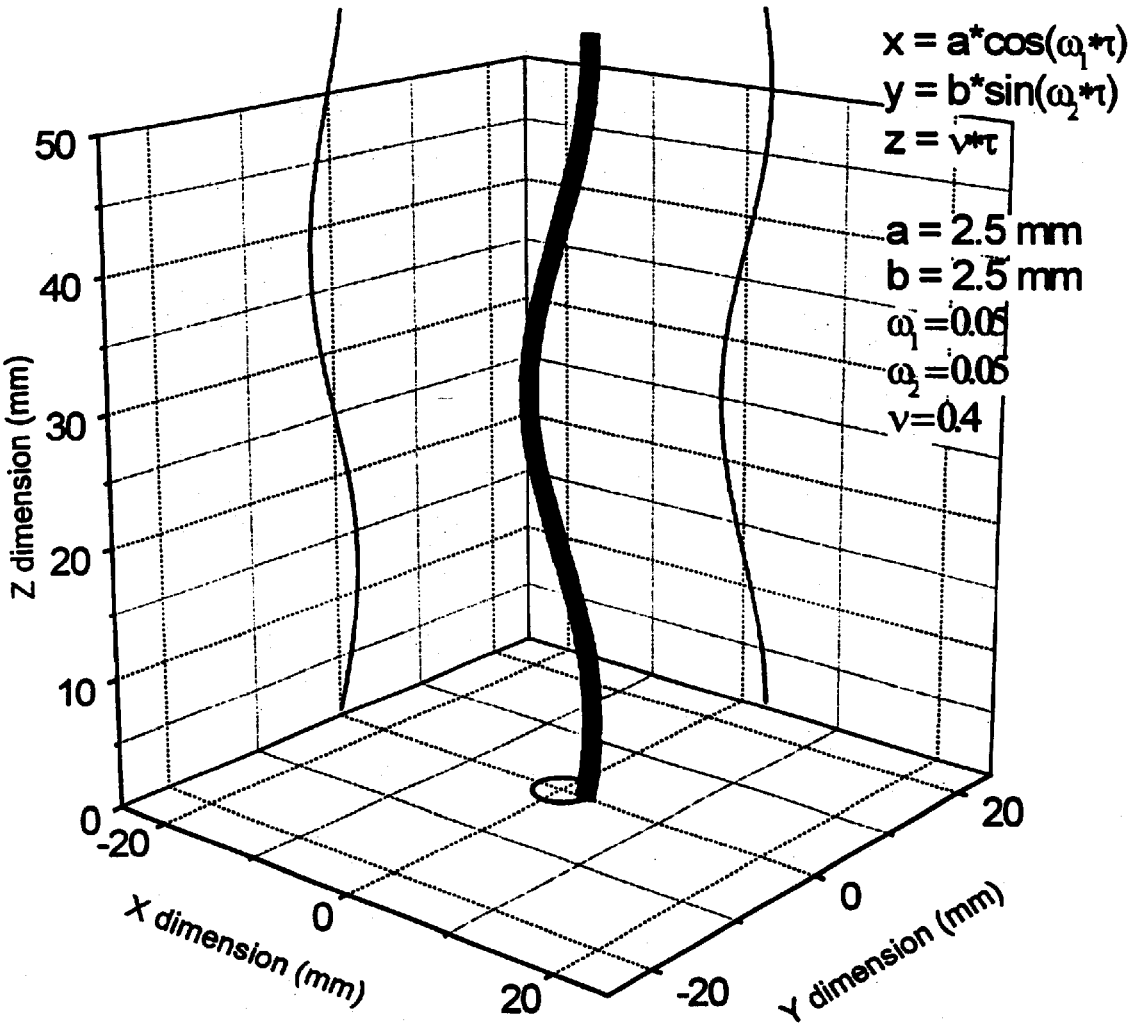
FIG. 3 is a mathematical simulation of the three-dimensional twisted shape of a 50 mm long fiber with the fiber depicted in the center and projected profiles.
Figure 4:
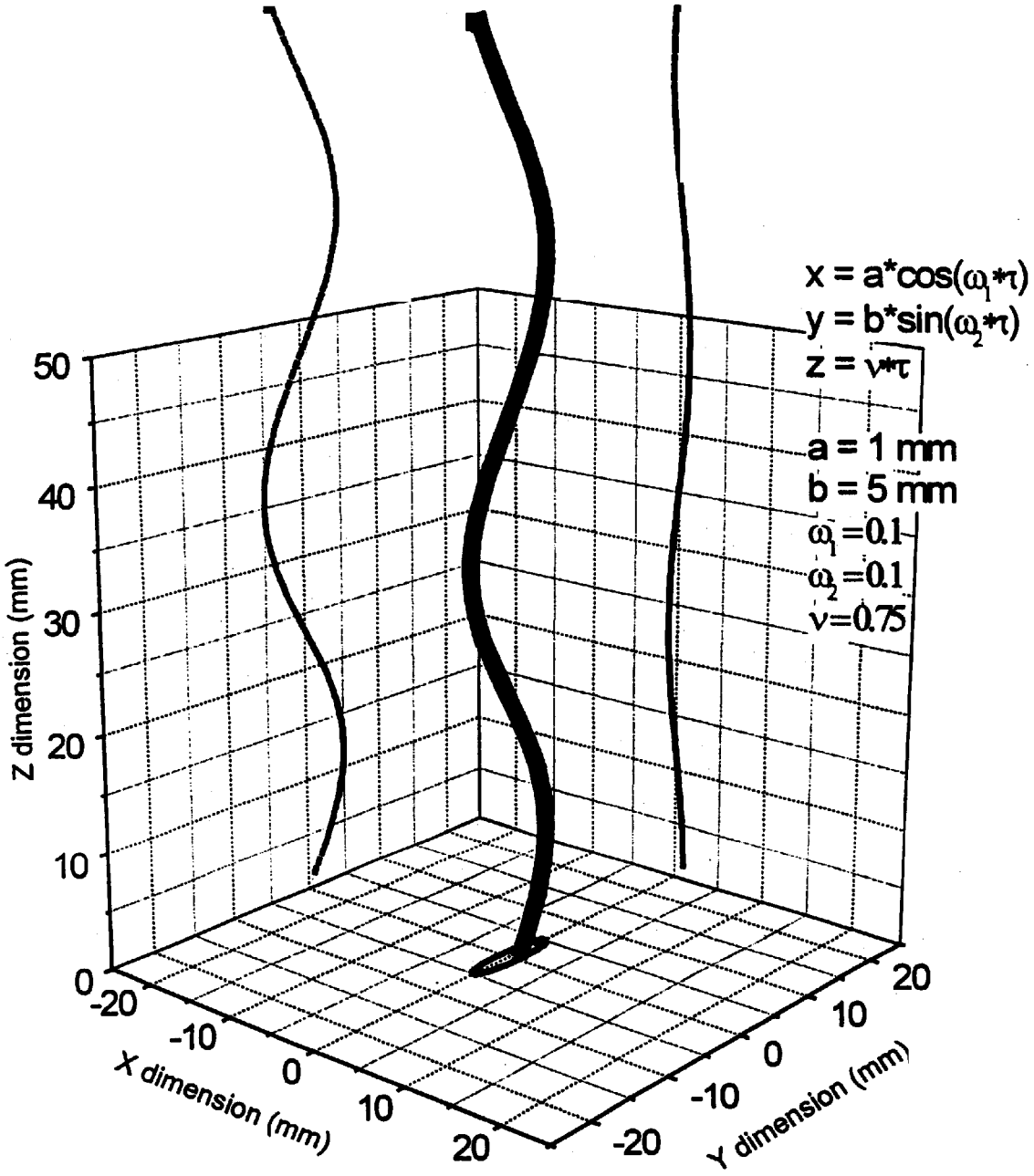
FIG. 4 is a mathematical simulation of the three-dimensional twisted-flattened shape of a 50 mm long fiber with the fiber depicted in the center and projected profiles.

As seen in the enlarged graphic illustration of FIG. 2, many of the exemplary resultant sectioned fibers 16 will have a twisted shape. The curvature of twist will depend upon the number of twists per lineal foot of fiber. Preferably, the exemplary fibers of the invention have a flat shape (as shown in FIG. 2) such as by starting with fibers that are extruded with a flat shape and then twisting them into a rope, or by flattening fibers by subjecting them to twisting and rolling between opposed rollers.

Fibers that are twisted around with other fibers and then cut in accordance with the invention may have, when viewed from the side, a slight or pronounced arch or (if twisted with more turns per linear length) even an "S" shape within the separate cut fiber length. Moreover, an exemplary fiber 16 viewed in a direction parallel to or along its length (as designated by the arrow at 18), will have, if it is flat or flattened a first end 21 having a width dimension (edge-to-edge) that is greater than a thickness dimension, and thus it can have an orientation different from cross-sectional profiles of other portions along the length of the flat or flattened fiber 16, as shown in the circular enlarged diagrams of FIG. 2, which show cross-sectional profiles taken at portions of the fiber 16 indicated as at 19, 20, 21, 22 and 23.

Accordingly, an exemplary fiber of the invention can be formed by twisting together a plurality of fiber strands to form a twisted fiber bundle (e.g., 2–5000 filaments, 1–96 twists per lineal foot, and preferably 18 strands using 6–18 twists per lineal foot); and then rolling the twisted fiber bundle onto a bobbin for shipment or otherwise cutting the twisted fiber bundle into separate fiber lengths (e.g., 5–100 mm) for use in reinforcing a matrix material. Preferred fibers having a flat or flattened shape will tend to have opposing first and second fiber ends (after cutting) wherein the opposing ends have orientations that differ by at least 30 degrees (e.g., one-twelfth of a twist or turn) and more preferably at least 90–360 degrees (e.g., one-quarter twist to one complete twist).

It can be further appreciated that some exemplary fibers 16 of the invention can have a sinusoidal character when viewed from the side, and more preferably a sinusoidal character when viewed from the side at an angle with respect to the line that intersects the opposing ends of the fiber. However, unlike fibers of the prior art which are "crimped" so as to have a two-dimensional wave pattern (see e.g., World Patent Application WO 99/36640 (Published Jul. 22, 1999), exemplary fibers 16 made by the twist-imparting process of the present invention can be made to have a three-dimensional curve due to the fact that they have been twisted about or wrapped around other fibers and therefore have curvatures in more than just two directions.

Accordingly, still further exemplary fibers 16 of the invention may be said to have a helical shape, somewhat analogous to model representations of DNA helixes, in cases where a high degree of twisting is used.

In further exemplary fibers and processes of the invention, a bonding agent or wetting agent can be used to increase the bonding between fibers, such that they can be cut while in a twisted fiber bundle configuration and remain temporarily bonded together, but which can allow individual fibers to separate when subjected to agitation within a fresh concrete or mortar mix. Conventional wetting agents are known. For example, U.S. Pat. No. 5,399,195 of Hansen, incorporated herein by reference, discloses the use of wetting agents normally applied to synthetic fibers to render them hydrophilic, such as fatty acid esters of glycerides, fatty acid amides, polyglycol esters, polyethoxylated amides, non-ionic surfactants and cationic surfactants. U.S. Pat. No. 5,753,368 of Berke et al., incorporated herein by reference, discloses a concrete bond strength enhancing fiber coating material such as a glycol ether, and preferably a dipropylene glycol-t-butyl ether. Fibers of the invention therefore can be made using a wetting agent, bonding agent, or mixture thereof.

Fibers for reinforcing matrix materials preferably (after cutting) have average lengths of about 5–100 mm (and more preferably 5–50 mm); average widths of 0.25–8.0 mm.; and average thicknesses of 0.005–3.0 mm. It is possible to exceed these preferred limits without straying from the spirit of the present invention. The length, width, and thickness dimensions may depend on the nature of the fiber material and use contemplated (e.g., polyolefin, polyamide, steel, etc.) and the matrix material contemplated for reinforcement. The unique and novel morphologies of the fibers of the present invention are intended to be used over a range of fiber and matrix materials, although the greatest challenge and the predominant purpose of the present invention is to provide fibers having at least one synthetic polymer, and preferably at least two polymers (e.g., a "multipolymer") blended together, or at least one synthetic polymer and steel blended together, for reinforcing hydratable cementitious matrix materials such as concrete or shotcrete.

If pulleys or other tensioning devices are used to further impart the twisting shape in the fiber material memory, it will be important to use sufficient force without shredding the fiber material to the point at which the integrity of the individual fibers in the rope is lost. For example, a series of pulleys may be arranged in opposed arrays through which the twisted precursor fiber bundle travels serpentine-like, and one series of the arrayed pulleys may be connected to weights or springs that exert adjustable tension on the twisted fiber bundle. If rollers used for this purpose (e.g., such as to flatten or otherwise compress) the twisted fiber bundle, then the distance between the rollers must not be such as to shred the individual fibers constituting the twisted fiber bundle. As polymer synthetic fibers are generally provided having equivalent diameters (or thicknesses) of average 0.5–1.0 mm, the rollers (e.g., steel rollers) may be set apart at a distance somewhat less than this (say about 0.01–0.3 mm), depending upon the nature of the fiber material, ambient temperature, and other processing conditions.

An exemplary method for reinforcing hydratable cementitious materials comprises: adding to a cement, mortar, cement mix, or concrete mix (dry or wet), in an amount of 0.05–15% by volume in the cementitious materials, the above-described exemplary fibers of the invention. The cementitious composition is then mixed to obtain a concrete, mortar, or paste mix in which the individual fibers become substantially distributed uniformly throughout the mix. The mix is then cast into a configuration or structure. More preferably, the addition amount of fibers is 0.05–5.0 vol. %, and more preferably 0.5–2.0 vol. %, based on the concrete. The term "configuration" means and refers to a foundation, a slab, a wall, a block, a segment of a retaining wall, a pipe, or portion of a civil engineering structure, bridge deck, tunnel, or the like.

The invention further provides hydratable cementitious compositions incorporating the above-described fibers. The composition can be provided as dry mix of the fibers in combination with a dry binder (e.g., Portland cement), or made by incorporating the fiber or fiber bundles into a wet cementitious mix and allowing the mix to harden into a structure.

For application into a concrete matrix material, as one example, the plurality of fibers or fiber bundles may be further packaged together within bags or containers, such as Grace Concrete Ready-Bag® packaging available from Grace Construction Products, Cambridge, Mass.

EXAMPLE 1

Multipolymer fibers were tested for dispersion abilities in fresh concrete. A control sample was first tested, and this comprised monofilament fibers of approximately 3000 denier (e.g., 3000 grams per 9000 meters) of polypropylene/poly-ethylene fibers having 50 mm average length, 1.15 mm average width, and 0.38 mm average thickness. These fibers were added in an amount of 63 kg by hand into 7 cubic meters of concrete in a mixing drum turning at 15 revolutions per minute (rpm). It took approximately 1.5 minutes to feed the fibers by hand into the drum of the Ready Mix Truck. Once the fibers disappeared from the surface of the concrete mix, 5 more minutes of mixing then occurred.

The concrete mixture was examined, and approximately 200 fist-sized clumps or "balls" of fibers (stuck together) were visually identified.

The mixing drum was then emptied and the process was repeated, but this time with the three-dimensional twisted fibers of the invention. 63 kg of the three-dimensional twisted fibers were added to the drum of the Ready Mix Truck, which was filled with 7 cubic meters of concrete, within 1.5 minutes. After 5 more minutes of mixing, the concrete mixture was examined, and no clumps or balls of fibers were seen.

Thus, the invention provided advantages in terms of increasing the dispersion characteristic of reinforcing fibers and also in terms of avoiding clumps or fiber "balling." The fibers may be introduced into the concrete mix, surprisingly, without being coated (e.g., with wetting agent or dispersing aid) or pre-bundled using dispersible packaging.

The foregoing examples are provided by way of illustration only and are not intended to limit the scope of the invention.

What is claimed is:

1. Fibers for reinforcing concrete, comprising: a plurality of fibers having an average length of 5–100 mm, an average width of 0.25–8.0 mm, an average thickness of 0.005–3.0 mm, and first and second opposed ends defining an intermediate portion therebetween having a three-dimensional twist, the three-dimensional twist substantially following a curve described by an equation $$\begin{pmatrix} x \\ y \\ z \end{pmatrix} = \begin{pmatrix} a \cdot \cos(\omega_1 \cdot \tau) \\ b \cdot \sin(\omega_2 \cdot \tau) \\ v \cdot \tau \end{pmatrix}$$

wherein a, b, $\omega_1, \omega_2$, v and $\tau$ are real numbers, and wherein a and b are bounded by 0.25 mm$\leqq$a, b$\leqq$25 mm.

2. The fibers of claim 1 wherein said first and second opposed ends each have width and thickness dimensions with width dimensions exceeding thickness dimensions, said widths of said first and said second opposed ends being twisted and thereby having different orientations.

3. The fibers of claim 2 wherein said widths of said first and second opposed ends are oriented in directions that are non-coplanar with each other.

4. The fibers of claim 3 wherein said widths of said first and second opposed ends are oriented between 15°–720° out of phase with each other.

5. The fibers of claim 4 wherein said widths of said first and second opposed ends are oriented between 15°–360° out of phase with each other.

6. The fibers of claim 1 wherein said three-dimensional twist comprises a curve in an "x" direction defined by the width of a first fiber end, a curve in the "y" direction defined as perpendicular to the "x" direction.

7. The fibers of claim 1 wherein said curved fiber bodies are twisted in two directions with respect to a line defined between said opposed first and second fiber ends.

8. The fibers of claim 6 wherein said curved bodies have curvatures that vary from fiber to fiber within said plurality of fibers.

9. The fibers of claim 1 wherein said fibers comprise at least one synthetic polymer, at least one metal, at least one composite material, or a mixture thereof.

10. The fibers of claim 9 wherein said fibers comprise at least two polymers whereby said fibers are operative to fibrillate when subjected to agitation in a cementitious mix.

11. The fibers of claim 1 wherein said fibers comprise a mixture of at least two different polymers.

12. The fibers of claim 10 wherein some of said individual fibers within said plurality of fibers comprise at least two polymers and are operative to fibrillate when subjected to agitation in a concrete or mortar mixture, said fibers being partially fibrillated at either one of said ends or within said intermediate body portion between said ends.

13. The fibers of claim 12 wherein some of said individual fibers are partially fibrillated within said intermediate body portion.

14. The fibers of claim 1 wherein said fibers have twist-curvatures made by providing a bundle of 6–5000 individual continuous fiber strands having been twisted together into a twisted fiber bundle using 1–96 turns per linear foot to impart memory of twisting into the structure of the individual fibers, and cutting said twisted fiber strand bundle to provide individual fibers.

15. The fibers of claim 1 wherein said fibers have twist-curvatures made by providing a bundle of 6–5000 individual continuous fiber strands having been twisted together into a twisted fiber bundle using 1–96 turns per linear foot of fiber length and subjected to tension or compressive forces to enhance the memory of twisting into the structure of the individual fibers, and cutting said twisted fiber strand bundle to provide individual fibers.

16. The fibers of claim 1 wherein said polymeric fibers are fibrillatable monofilament fibers operative to fibrillate into smaller component strands when agitated in a fresh concrete or mortar mix.

17. The fibers of claim 1 wherein said fibers are arranged into bundles of two or more fibers, said bundles comprising fibers of at least two different polymers.

18. The fibers of claim 1 wherein said fibers are arranged into bundles of two or more fibers, said bundles comprising synthetic polymer fibers and metal fibers.

* * * * *